United States Patent [19]

Rosenwald

[11] 4,000,780

[45] Jan. 4, 1977

[54] STORM CHOKE

[75] Inventor: Gary W. Rosenwald, Tulsa, Okla.

[73] Assignee: Cities Service Company, Tulsa, Okla.

[22] Filed: Oct. 3, 1972

[21] Appl. No.: 294,743

[52] U.S. Cl. ..... 166/72

[51] Int. Cl.[2] ..... E21B 43/12

[58] Field of Search ..... 166/224 R, 224 S, 72, 166/73

[56] References Cited

UNITED STATES PATENTS

| | | | |
|---|---|---|---|
| 1,735,025 | 11/1929 | Watts | 166/72 X |
| 2,831,539 | 4/1958 | Endean et al. | 166/73 |
| 2,963,089 | 12/1960 | Sizen | 166/72 |
| 3,007,524 | 11/1961 | Pistole et al. | 166/72 |
| 3,288,221 | 11/1966 | Howard et al. | 166/72 X |
| 3,310,114 | 3/1967 | Dollison | 166/72 X |
| 3,791,445 | 2/1974 | True | 166/224 X |

*Primary Examiner*—H. Hampton Hunter

[57] ABSTRACT

Accidental blow out of a producing oil or gas well is prevented by means of a storm choke having a valve disc and seat located in a production tubing which extends from the surface to a producing petroleum reservoir. The valve disc is equipped with an operating means which continuously urges the disc toward a position which is opposite from normal with regard to engagement with the seat, i.e. the disc is continuously urged toward the seat if the valve is normally open and away from the seat if it is normally closed. Mechanical means which can be operated from the surface are employed for selectively securing the valve disc in a normally opened or closed position and for releasing the disc for the automatic movement thereof into or out of the valve seat.

9 Claims, 3 Drawing Figures

14
12
17
16
2
15
18
13
1
3
4
6
7
10
11
9
8
5

STORM CHOKE

BACKGROUND OF THE INVENTION

Due to fire and health hazards, the potential loss of produced fluids, and potential damage to the environment, there has been increased emphasis on use of downhole safety shut-off valves, e.g. storm chokes, for flowing petroleum wells. By means of a storm choke, the flow of petroleum fluids through the production tubing of a flowing well can be shut off in an emergency, thus providing means for preventing or controlling an accidental blowout.

Most of the storm chokes now used are of three basic types which are installed in the well bore:

1. A valve which automatically closes and thus shuts off flow of fluid when the pressure differential across the valve becomes too great. More specifically, a valve of this type is designed to shut automatically if the flow of fluid through it exceeds a certain limit.

2. A hydraulically activated valve to which hydraulic fluid is pumped from the surface when an emergency arises.

3. A valve through which the fluid will flow only if the pressure in the well bore at the valve is above a pressure at which the valve is preset to close and which closes automatically if the pressure falls below the preset value.

None of the valve arrangements mentioned above has proven to be altogether satisfactory because of total dependence upon fully automatic operating systems which sometimes fail or else because it has not always been possible to complete an action at the surface which is necessary for opening or closing the valve.

It is therefore an object of the present invention to provide a simple and reliable storm choke which can be secured in a normally open or closed condition and which will close or open automatically upon manual or accidental release of the securing means. Other objects and advantages of the invention will become apparent from the following description which is, of course, intended to be illustrative rather than limitative.

SUMMARY OF THE INVENTION

The present invention resides in apparatus for controlling flow of petroleum fluids through the production tubing of a flowing well. A valve seat is located within the production tubing between the surface and producing reservoir. An operable valve disc is also located within the tubing and is adapted to engage and mate with the valve seat. Operating means is provided for urging the valve disc to move toward a position which is opposite from normal with regard to engagement of the disc with the seat. The apparatus can be arranged for either normal engagement or disengagement of the disc and seat, i.e. the valve can be either normally opened or closed. Operation of the valve disc toward or away from the seat can be accomplished by means of a pressurized fluid or a tensioned spring. Securing and releasing of the valve disc for movement can be accomplished by means of a mechanical linkage which extends up through and out of the production tubing at the surface and which is adapted for movement within the tubing. Means can be employed at the surface for selectively securing and moving the mechanical linkage within the tubing.

DESCRIPTION OF PREFERRED EMBODIMENTS

Figure 1:
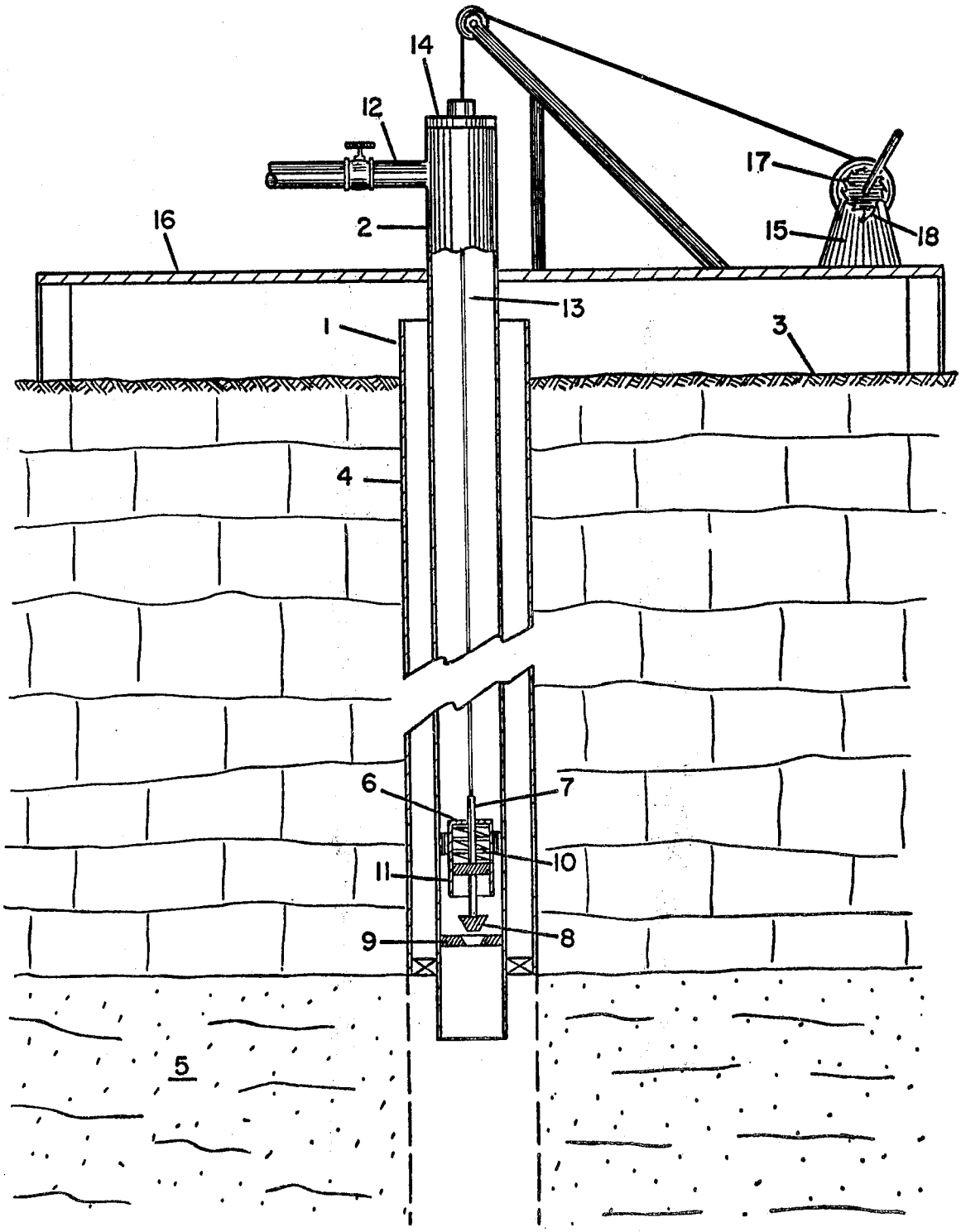
FIG. 1 is a somewhat diagrammatical sectional view of a producing well having one embodiment of the apparatus of the present invention installed therein.

In FIG. 1, a production well generally indicated at 1 has a string of production tubing 2 which extends from above the surface of the earth 3 through a casing 4 to a petroleum producing reservoir 5.

A storm choke, generally represented at 6, is located within the production tubing between the surface and the producing reservoir and will be described later in greater detail with reference to FIG. 2. The choke comprises a stem 7 attached to a valve disc 8 and a valve seat 9 affixed coaxially within the tubing to the wall thereof. Spring 10 is compressed and continuously urges downward against a spring mount 11 affixed to the stem 7, thus urging the disc toward engagement with the seat. However, in the arrangement shown in FIG. 1 the storm choke is normally closed, so the disc must be held off the seat to provide a flow path for liquid through the tubing for recovery at the surface through line 12. The choke can be held open by means of a cable 13 attached to the top of stem 7 and which extends upward and out of the tubing through a guide and seal arrangement 14 and to a wench 15 mounted on platform 16 at the surface. The wench is provided with a ratchet 17 and a pawl 18 so that tension can be placed on the cable and thus secure the stem 7 and the attached disc 8 in a position so that the valve remains open until there is a need to close it. Shutting of the valve is thus accomplished merely by backing off on the wench, actual engagement of the disc and seat being accomplished by tension in the spring 10. It will also be appreciated that the valve will shut automatically in the event that the cable should become broken accidentally, e.g. as might occur from storm or fire damage to platform 16 or tubing 2.

Figure 2:
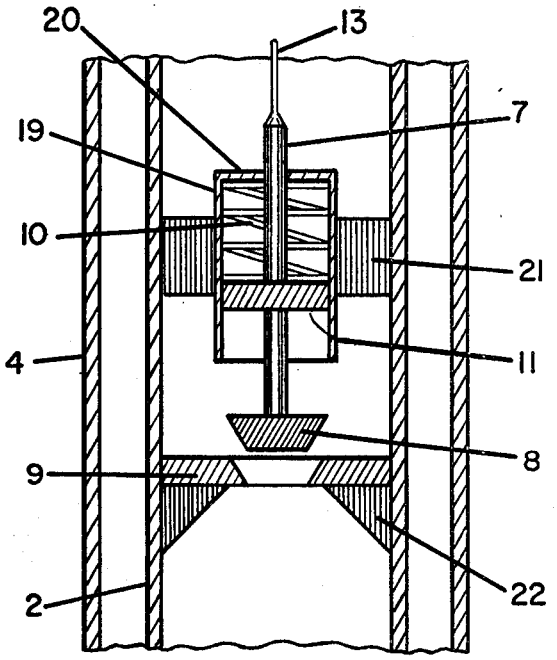
FIG. 2 is a sectional view of an embodiment of the invention wherein the valve disc is normally disengaged from the valve seat.

The storm choke of FIG. 1 is more clearly illustrated in FIG. 2. A cylinder 19 having an end closure 20 at the top is coaxially mounted to the wall of tubing 2 by means of brackets 21. One end of the compressed, helical spring 10 abuts the closure 20 whereas the other end of the spring abuts the mount 11 which is affixed to stem 7. The stem extends through a central opening in closure 20 and is free to move axially therein. Spring mount 11 on the stem is in the form of a piston which can slide in the cylinder. The piston thus also serves as a guide for maintaining the valve disc 8 coaxially aligned with the seat 9. As can be seen in the drawing the disc and the seat can be provided with matching chamfered or beveled edges to provide larger sealing surfaces between the two members. Where preferred, gussets 22 between the wall of the tubing and the seat can be employed for a more rigidized construction.

Figure 3:
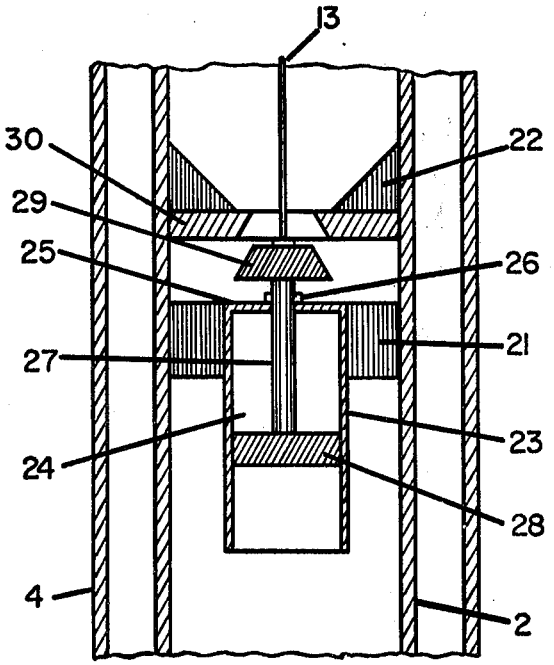
FIG. 3 is a sectional view of another embodiment of the invention wherein the valve disc is normally engaged with the valve seat.

A somewhat different embodiment of the invention is shown in FIG. 3. As illustrated therein the cylinder 23 serves as a container for a compressible fluid represented at 24. The end closure 25 is thus equipped with a seal 26 through which stem 27 extends from it attachment with the piston 28 to the valve disc 29. In FIG. 3, the valve is shown in an open condition but is held normally closed by exerting upward tension on the cable 13. When the valve is closed the fluid 24 in the cylinder 23 is compressed between the end closure 25 and the piston 28. Therefore, when tension on cable 13 is eased, the fluid 24 is permitted to expand, thus driving the piston 28 downward and withdrawing the valve disc 29 from engagement with the valve seat 30.

It will be appreciated that a fluid-sealing relationship should exist between the wall of the cylinder 23 and the piston 28 in order to contain the fluid 24 under pressure. Sealing rings such as O-rings can be employed for this purpose and any suitable gas such as air, nitrogen, an inert gas, or the like, can be employed as the compressible fluid.

Alternatively to use of a cylinder and piston as shown in FIG. 3, the compressible fluid can be contained within a collapsible bellows to provide a more convenient means of sealing the fluid under pressure. In such a case one end of the bellows can be attached to the wall of the tubing while the other end is attached to the stem 27 for operation of the valve disc 29 upon expansion and contraction of the bellows. It will also be understood that the valve of FIG. 2 can be operated with a compressed fluid instead of a spring whereas the valve of FIG. 3 can be operated with a spring instead of a fluid.

In FIGS. 2 and 3 the valve discs and seats are coaxially aligned within the production tubing, but it will be appreciated that opening of the seat can be located somewhat off center while still arranged to receive a disc aligned coaxially with the opening. Discs and seats having matching bevels are shown for achieving effective sealing by the valve, but flat or ridge-and-groove arrangements can also be employed.

Whether a spring or compressed fluid is employed for operating the valve, the urging force for moving the valve disc is against the immovable production tubing 2 in one direction and against a disc operating member such as mount 11 or piston 28, in the opposite direction. The cylinders 19 and 23 are thus rigidly affixed to the tubing 2 whereas the spring mount or piston are attached to the movable disc.

After the storm choke of the present invention has been installed, the operability thereof can be easily tested at anytime merely by altering the tension on the securing means, e.g. by loosening the cable 13 to determine whether the valve opens or closes, depending upon whether it is normally closed or open, and checking for initiation or interruption of flow in line 12. After checking in this manner, tension on the cable can be restored and the valve resecured in a normally closed or open condition.

The choke of FIG. 2 can be used with a flowing well through which petroleum fluids are normally produced whereas the choke of FIG. 3 can be used in a relief well which is normally kept shut off and is opened only when it is desirable to reduce pressure in a producing formation, e.g. upon blow out of a producing well leading from the same formation. Whether the valve be of a normally open or closed variety, it can be quickly shut or opened, respectively, merely by releasing tension on the securing means, e.g. by tripping the wench 15. It will also be appreciated that should the cable 13 be broken accidentally as by storm or fire on the platform 16, the valve would automatically open or close in accordance with the desired intention.

While the invention has been described with reference to particular apparatus and arrangements thereof, it will nonetheless be understood that still other embodiments will become apparent which are within the spirit and scope of the invention defined in the following claims.

What is claimed is:

1. In a producing well having a production tubing which extends below the surface to a producing reservoir, apparatus for controlling flow of fluid through the production tubing which comprises:

a. a valve seat located within the production tubing, b. an operable valve disc located within the tubing, the disc being adapted to engage and mate with the valve seat, c. operating means for continuously urging the valve disc to move toward a position which is opposite from normal with regard to engagement of the disc with the valve seat, and d. mechanical means for selectively securing the valve disc in a normal position with regard to engagement with the seat and for releasing the disc for movement by the operating means, and wherein said mechanical means comprises a mechanical linkage attached to the disc and which extends up through and out of the production tubing and is adapted for movement within the tubing, and further comprising means at the surface for selectively securing and moving the mechanical linkage within the tubing.

2. Apparatus as in claim 1 wherein the valve disc is normally disengaged from the valve seat.

3. Apparatus as in claim 1 wherein the valve disc is normally engaged with the valve seat.

4. Apparatus as in claim 1 wherein the means for urging the valve disc to move comprises a tensioned spring.

5. Apparatus as in claim 1 wherein the means for urging the valve disc to move comprises a compressed fluid.

6. Apparatus as in claim 1 wherein the operating means for continuously urging the valve disc to move comprises a sealed but expansible chamber for a contained fluid, the chamber being located within the production tubing and secured to the wall thereof, fluid within the chamber being relatively compressed when the valve disc is secured in a normal position with regard to engagement with the valve seat and relatively expanded when the disc is released from movement by the operating means.

7. Apparatus as in claim 6 wherein the sealed but expansible chamber is a cylinder having a fitted piston therein, the cylinder being axially aligned with the valve disc and the piston being attached to the disc.

8. Apparatus as in claim 1 wherein the valve seat comprises an attached valve stem aligned axially with the disc, a mount on the valve stem which receives one end of a compressed spring, and a spring mount attached to the tubing wall and which receives the other end of said spring.

9. A valve comprising:

a. a valve seat, b. an operable valve disc adapted to engage and mate with the valve seat, c. operating means for urging the valve disc to move toward a position which is opposite from normal with regard to engagement of the disc with the valve seat, and d. mechanical means for selectively securing the valve disc in a normal position with regard to engagement with the seat and for releasing the disc for movement by the operating means.

* * * * *